US006059606A

United States Patent [19]

Okuyama et al.

[11] Patent Number: 6,059,606

[45] **Date of Patent: *May 9, 2000**

[54] SHELLED CONNECTOR HAVING GROUND CONTACT

[75] Inventors: Takeshi Okuyama; Kazuyuki Futaki, both of Suzaki, Japan

[73] Assignee: Fujitsu Takamisawa Component Limited, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/887,370

[22] Filed: Jul. 2, 1997

[30] Foreign Application Priority Data

Mar. 19, 1997 [JP] Japan ..... 9-066333

[51] Int. Cl.[7] ..... H01R 13/648

[52] U.S. Cl. ..... 439/607; 439/564

[58] Field of Search ..... 439/607–610, 439/108, 564, 569, 570–572

[56] References Cited

U.S. PATENT DOCUMENTS

| | | | |
|---|---|---|---|
| 4,938,704 | 7/1990 | Fujiura | 439/607 |
| 4,943,244 | 7/1990 | Teck et al. | 439/607 |
| 5,228,873 | 7/1993 | Hirai | 439/607 |
| 5,564,945 | 10/1996 | Domingos et al. | 439/607 |
| 5,599,207 | 2/1997 | Lai | 439/607 |

*Primary Examiner*—Hien Vu
*Attorney, Agent, or Firm*—Staas & Halsey, LLP

[57] ABSTRACT

An shelled connector secured to a circuit board of an electric equipment for receiving a counter connector is capable of shielding an array of connector contacts from an external electromagnetic noise by encapsulating an insulating connector body with a metal shell which is directly connected to a ground terminal pad on the circuit board. For one embodiment according to the resent invention, the metal shell has an extended portion connecting the metal shell directly to a ground terminal pad on the front surface of the circuit board by soldering.

11 Claims, 4 Drawing Sheets

SHELLED CONNECTOR HAVING GROUND CONTACT

BACKGROUND OF THE INVENTION

1. Field of the Invention

This invention relates to a connector for electric equipment and electric equipment having the connector, particularly to a shelled connector and electric equipment having a printed circuit board with the shelled connector secured thereto.

2. Description of the Related Art

A shelled connector secured on a printed circuit board has a metal shell encapsulating a contact housing. The metal shell is connected to an ground terminal on the printed circuit board to shell an electromagnetic or electrostatic noise from the external environment. Since practical connection of the metal shell with the ground terminal on the printed circuit board is usually carried out by using a metal fitting screwed down to the metal shell, an electric path many electric contacts between them is created. This tends to cause an increase in ground impedance due to instability in contact resistance.

As shown in FIG. 1, a conventional shelled connector 1 of a right-angle type, comprises an insulating body 1*a,* electric contacts 1*b* in a contact housing 1*a*-1 encapsulated by a metal shell 1*d,* and terminal pins 1*c* coupled to the respective contact. The terminal pins 1*c* are arranged perpendicularly to the direction to receive the counter cable plug connector (not shown) by insertion. The shelled connector 1 has a screw hole 1*a*—1*a* penetrating both the insulating body 1*a* and the metal shell 1*d* for securing the shelled connector to the chassis panel. The shelled connector 1 also has a through-hole 1*a*-1*b*, at both ends of the connector 1, in the L-shaped securing portion 1*a*-2 of the insulating body 1*a* for inserting the tip 1*e*-2 of the temporary metal tack 1*e*. The tip 1*e*-2 of the temporary metal tack 1*e* is tapered like shape of an arrow with a slit 1*e*-2*a* along the axis, which makes it easy to insert the tip 1*e*-2 into the narrow through-hole by elastic deformation and difficult to pull it out of the hole by a hooking action. FIG. 2 is a sectional view of the conventional shelled connector shown in FIG. 1 mounted on a metal chassis panel 3*a* of a metal cabinet 3 and a circuit board 2. The shelled connector 1 is mounted on a printed circuit board 2 by inserting terminal pins 1*c* into through-holes 2*a* for signals and also inserting the tip 1*e*-2 of the temporary metal tack 1*e* into a through-hole 2*b*-1 for a ground line and soldering each of them. The shelled connector 1 mounted on a printed circuit board 2 is secured to the metal chassis panel 3*a* of a metal cabinet 3 by inserting the contact housing 1*a*-1 into a trapezoidal shaped hole 3*a*-1 of the metal chassis panel 3*a* and also inserting a screw 4 into each screw hole in both outer sides of the trapezoidal shaped hole to fit in with the screw hole 1*a*-1*a* of the L-shaped securing portion 1*a*-2 of the insulating body 1*a*. Thus, the ground path by this structure is from the metal shell 1*d* to the through-hole 2*b*-1 for a ground line by way of the panel 3*a,* the screw 4, and the temporary metal tack 1*e,* successively. However, this structure of the ground line has so many contacts that an electric connection is apt to be instable and fails to provide a reliable ground contact. Therefore, it has been desired for a long time to provide a shelled connector having a stable and reliable ground contact to the circuit board.

SUMMARY OF THE INVENTION

An object of the present invention is to provide a shelled connector mounted on a printed circuit board of an electric equipment in which the metal shell is directly connected to a ground contact on the printed circuit board.

Another object of the present invention is to provide a shelled connector mounted a printed circuit board of an electric equipment in which the metal shell has a metal portion extended to the ground contact on the printed circuit board.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
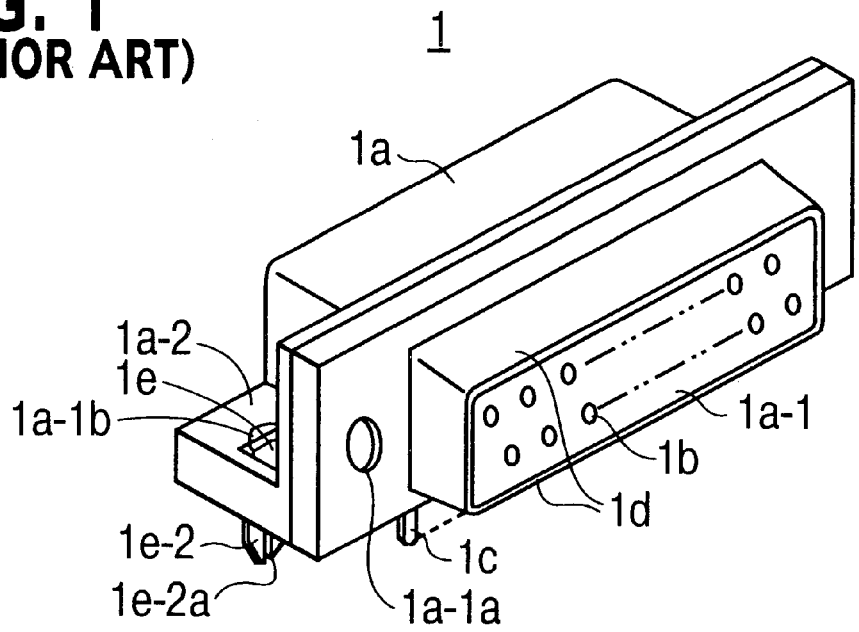
FIG. 1 (PRIOR ART)
FIG. 1 is a bird view of a conventional shelled connector.
Figure 2:
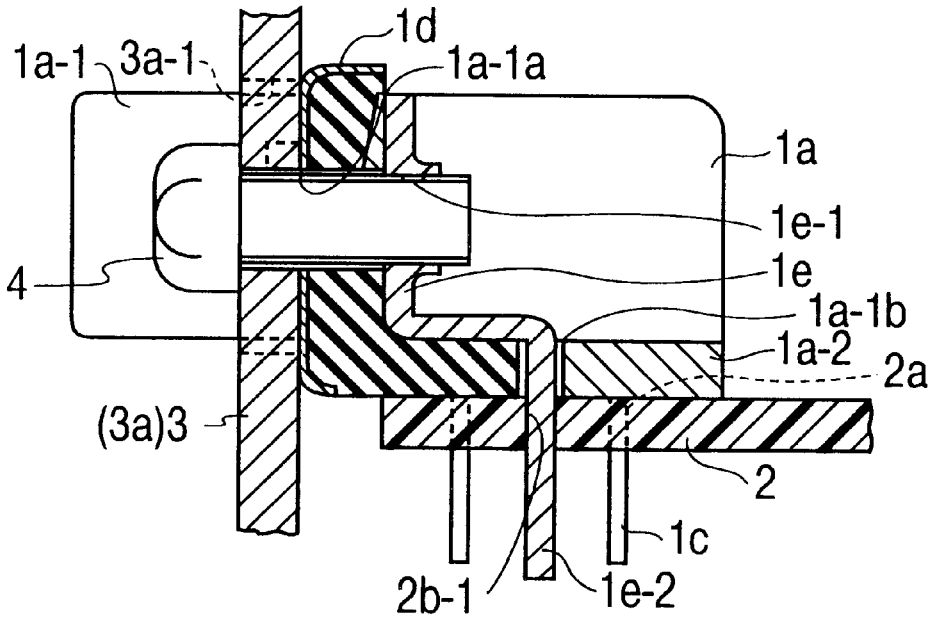
FIG. 2 (PRIOR ART)
FIG. 2 is a sectional view of the conventional shelled connector shown in FIG. 1 mounted on a chassis panel and a circuit board.
Figure 3:
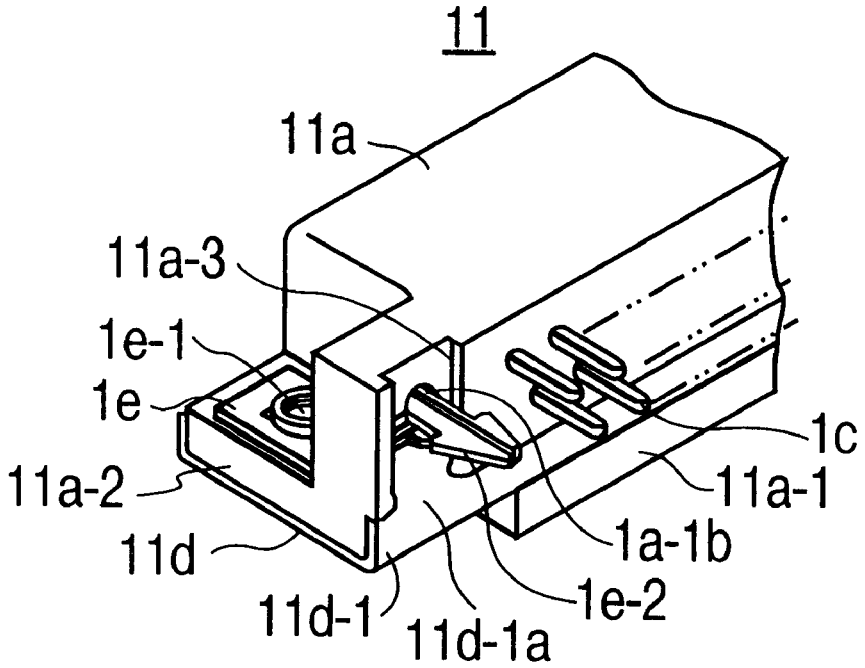
FIG. 3 is a partial bird view of a shelled connector for the first embodiment according to the present invention.
Figure 4:
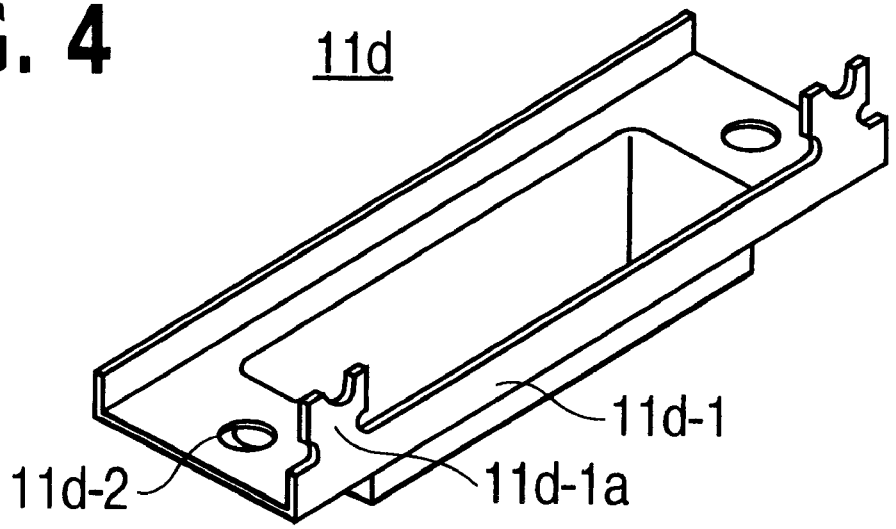
FIG. 4 is a bird view of a metal shell for the shelled connector shown in FIG. 3.

FIG. 3 is a bird view of a main part of the shelled connector of the first embodiment according to the present invention. In this embodiment, only the shell structure is different from that of the conventional connector. As shown in FIG. 3, dual-in-line electric contacts (not shown) in a contact housing 11*a*-1 are encapsulated by a metal shell 11*d,* and terminal pins 1*c* are coupled to their respective electric contacts. The terminal pins 1*c* are arranged perpendicularly to the direction in which the counter cable plug connector (not shown) is inserted. FIG. 4 is a bird view of a metal shell for the shelled connector shown in FIG. 3. The metal shell 11*d* has a screw hole 11*d*-2 on each opposite side, which correspond to screw holes 1*e*-1 of a temporary metal tack 1*e*. The metal shell 11*d* and the temporary metal tack 1*e* are secured to the L-shaped securing portion 11*a*-2 of the insulating body 11*a* through screw holes 11*d*-2. The insulating body 11*a* has a through-hole 1*a*-1*b* on a recessed portion 11*a*-3 of the bottom surface of the L-shaped securing portion 11*a*-2. The tip 1*e*-2 of the temporary metal tack 1*e* is inserted into the through-hole 1*a*-1*b* at opposite ends of the insulating body 11*a*.

The metal shell 11*d* has a bent portion 11*d*-1 along the bottom surface of the insulating body 11*a*. Further, the bent portion 11*d*-1 has, at opposite sides of the connector, an extended contact portion 11*d*-1*a* along the bottom surface of the insulating body 11*a*. The extended contact portion 11*d*-1*a* is in close proximity to the ground contact on the printed circuit board. This structure is made by drawing a sheet of metal and bending the elongated metal portion by pressing so that the elongated portion is fitted into the recessed region 11*a*-3 of the bottom surface of the insulating body 11*a*.

Figure 5:
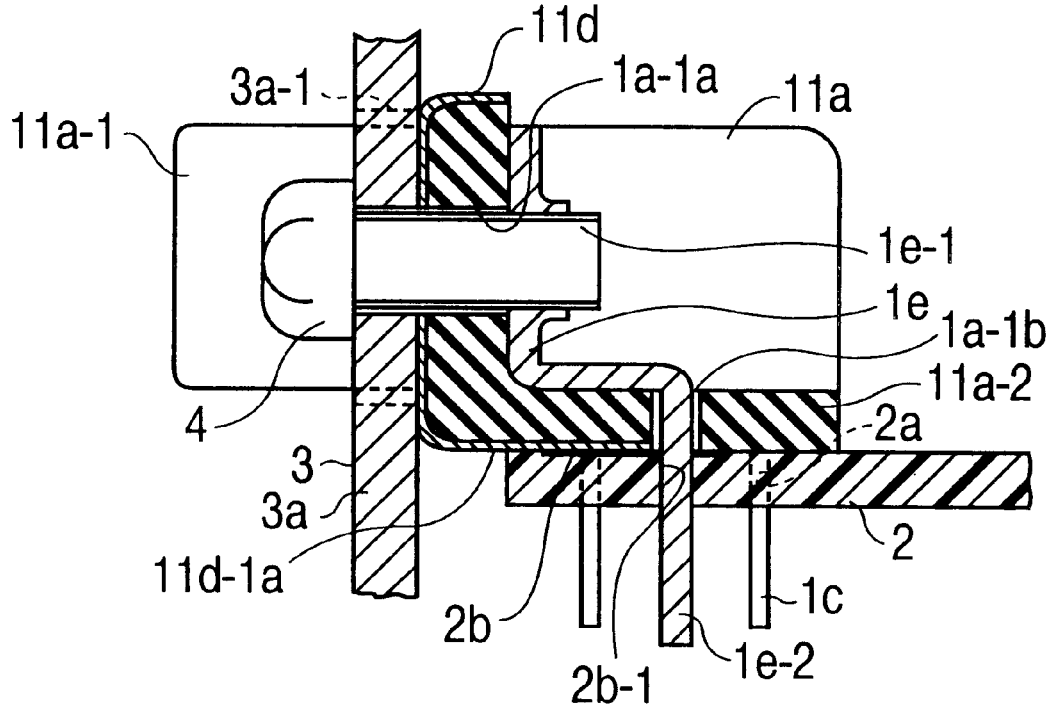
FIG. 5 is a sectional view of the shelled connector shown in FIG. 3 mounted on a chassis panel and a circuit board.

FIG. 5 is a sectional view of the shelled connector 11 shown in FIG. 3 mounted on a chassis panel 3*a* and a circuit board 2.

Similar to the conventional connector, the shelled connector 11 is mounted on a printed circuit board 2 by inserting terminal pins 1*c* into through-holes 2*a* for signals and also inserting the tip 1*e*-2 of the temporary metal tack 1*e* into a through-hole 2*b*-1 for a ground line and soldering each of them. The shelled connector 11 mounted on a printed circuit board 2 is secured to a metal chassis panel 3*a* of a metal cabinet 3 by inserting the contact housing 11*a*-1 into a trapezoidal shaped hole 3*a*-1 of the metal chassis panel 3*a* and also inserting a screw 4 into each screw hole 1*a*-1*a* in both outer sides of the trapezoidal shaped hole to fit in with the screw hole 1*a*-1*a* of the L-shaped securing portion 11*a*-2 of the insulating body 11*a*. The extended contact portion 11*d*-1*a* is laid down on a prolonged portion of the ground contact 2*b* on the surface of the circuit board 2. The extended contact portion 11*d*-1*a* and the prolonged portion of the ground contact 2*b* are soldered to each other when the tip 1*e*-2 is soldered to the metalized through-hole 2*b*-1. Thus, the ground path by this structure extends from the metal shell 11*d* directly to the through-hole 2*b*-1 for a ground line without any intermediate contacts. Therefore, the embodiment according to the present invention provides and a ground contact having low impedance which is stable and reliable for a long time usage.

Figure 6:
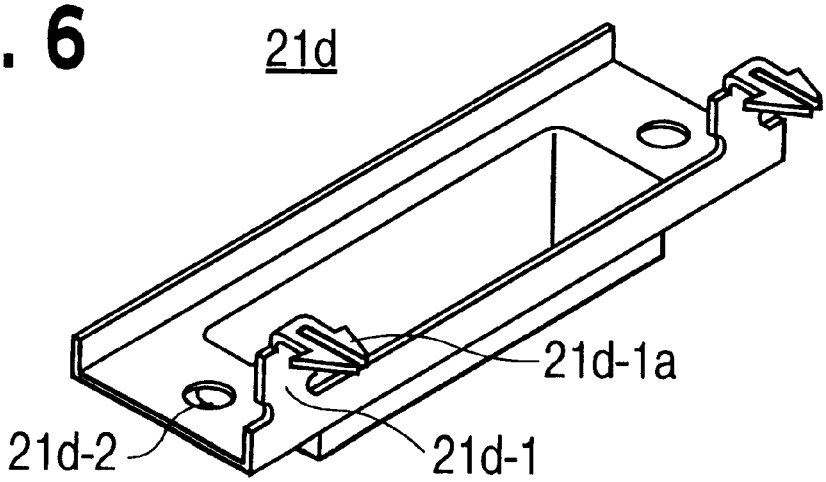
FIG. 6 is a bird view of the metal shell for the shelled connector of the second embodiment according to the present invention.

FIG. 6 is a bird view of the metal shell for the shelled connector of the second embodiment according to the present invention.

Figure 7:
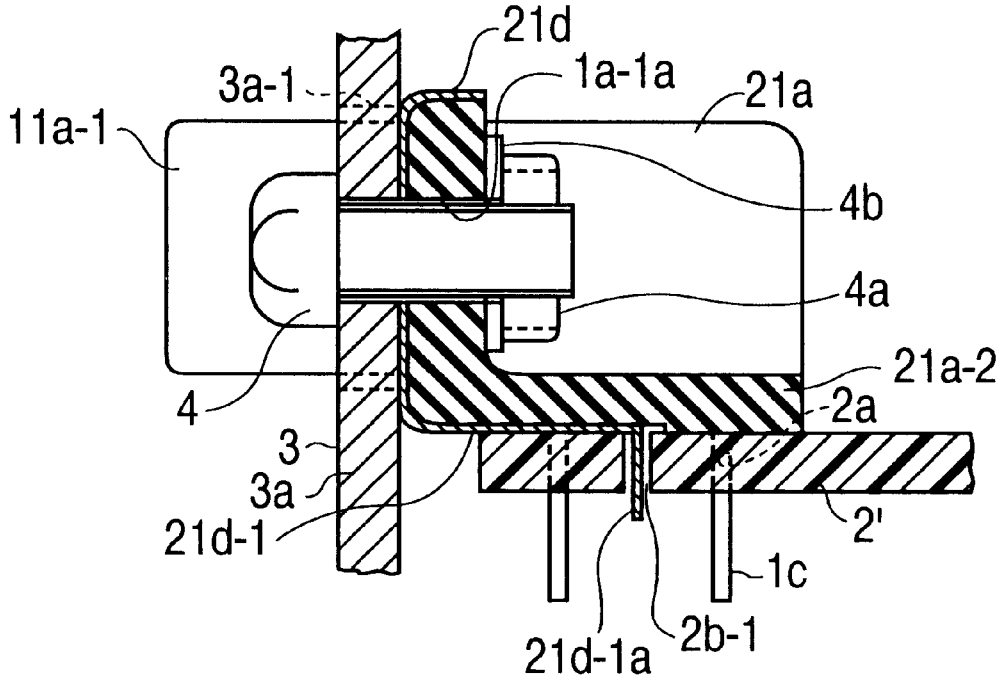
FIG. 7 is a sectional view of the shelled connector of the second embodiment mounted on a chassis panel and a circuit board.

In the second embodiment, a bent portion 21*d*-1 of the metal shell 21*d* has a tapered tip 21*d*-1*a* with a slit, which is further bent so that the tapered tip 21*d*-1*a* is inserted into the metalized through-hole 2*b*-1 for the ground contact on the circuit board 2 as similarly as shown in FIG. 5. The tapered tip 21*d*-1*a* is soldered to the ground contact on the circuit board 2 similar to the tip 1*e*-2 of the first embodiment. The L-shaped securing portion 11*a*-2 of the insulating body 11*a* can be secured to the metal chassis panel 3*a* of a metal cabinet 3 by a screw 4 and a nut 4*a* with a spring washer 4*b* such as a commercially available hexagon nut as shown in FIG. 7. The tapered tip 21*d*-1*a* can be formed monolithically with the metal shell, which eliminates the temporary metal tack 1*e* in FIG. 5. Since the structure is simple and the ground path is short, the ground contact of the shell is far more stable and reliable than that in the conventional connector. Although all the above illustrated embodiments are on a right-angle type connector, the structure and technique disclosed by the present invention can be equally applied to the straight type connector for coupling with a counter connector associated with either a flat cable or another printed circuit board.

What is claimed is:

1. A shelled connector connectable to a front surface of a circuit board having a ground terminal pad thereon, the shelled connector comprising:

an insulating body having a plurality of contacts and terminal pins, each of the contacts coupled to a corresponding one of the terminal pins inside said insulating body;

a conducting shell encapsulating said insulating body, said conducting shell having a ground contact integrally formed from said conducting shell and extending onto the ground terminal pad on the front surface of the circuit board and said conducting shell further having a temporary tack extending from said ground contact and securing said shelled connector temporarily to the circuit board before the terminal pins are soldered to respective terminal pads on the circuit board, whereby said conducting shell is connected directly to the ground terminal pad.

2. The shelled connector according to claim 1, wherein a bottom surface of said insulating body has a recessed area and said connecting portion is embedded in the recessed area such that a surface of the connecting portion is on a same plane with the bottom surface of said insulating body.

3. The shelled connector according to claim 1, wherein the temporary tack is inserted into a through-hole of the circuit board such that the shelled connector is secured tightly to the circuit board by spring and hooking actions of the temporary tack.

4. The shelled connector according to claim 1, wherein said connecting portion is made of a same metal sheet as that of said conducting shell.

5. The shelled connector according to claim 3, wherein said connecting portion is arranged on opposite ends of the shelled connector.

6. Electric equipment comprising:

a circuit board having a front and a back surface and a ground terminal pad; and a shelled connector secured to the front surface of said circuit board, wherein said shelled connector further comprises, an insulating body having a plurality of surfaces, an array of contacts arranged on a first one of the surfaces, and an array of terminal pins arranged on a second one of the surfaces, each of the contacts coupled to a corresponding one of the terminal pins inside said insulating body, said insulating body mounted on said circuit board by attaching the second surface to the front surface of said circuit board, and a conducting shell encapsulating said insulating body enclosing the array of contacts and surrounding surfaces thereof, said conducting shell having a ground contact extending onto the ground terminal pad on the front surface of said circuit board and a temporary tack extending from said ground contact and securing said shelled connector temporarily to the circuit board before the terminal pins are soldered to respective terminal pads on the circuit board, whereby said conducting shell is connected directly to the ground terminal pad.

7. The electric equipment according to claim 6, wherein said conducting shell makes contact with the front surface of said circuit board by attaching the back surface of said insulating body to the front surface of said circuit board.

8. The electric equipment according to claim 6, wherein said conducting shell makes contact with a ground terminal pad on the front surface of said circuit board by attaching the back surface of said insulating body to the front surface of said circuit board.

9. The electric equipment according, to claim 6, wherein said conducting shell is electrically connected to the ground terminal pad on the front surface of the circuit board by soldering.

10. The electric equipment according to claim 6, wherein said circuit board further comprises a through-hole metalized on side walls and surrounded surface areas on the front and back surfaces of said circuit board surrounding the through-hole for the ground terminal pad.

11. The electric equipment according to claim 10, wherein the metalized surrounded surface area on the front surface is asymmetrically extended from the through-hole.

* * * * *